US005899180A

United States Patent [19]

Fischer

[11] Patent Number: 5,899,180

[45] **Date of Patent: *May 4, 1999**

[54] VARIABLE VALVE GEAR, PARTICULARLY FOR INTERNAL-COMBUSTION ENGINES

[75] Inventor: Gert Fischer, Feldafing, Germany

[73] Assignee: Bayerische Motoren Werke Aktiengesellschaft, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/701,831

[22] Filed: Aug. 23, 1996

[30] Foreign Application Priority Data

Sep. 1, 1995 [DE] Germany ..... 195 32 334

[51] Int. Cl.[6] ..... F01L 1/12; F01L 13/00

[52] U.S. Cl. ..... 123/90.16; 123/90.22

[58] Field of Search ..... 123/90.15, 90.16, 123/90.2, 90.22, 90.27, 90.39, 90.44, 90.46, 90.65

[56] References Cited

U.S. PATENT DOCUMENTS

| | | | |
|---|---|---|---|
| 4,382,428 | 5/1983 | Tourtelot, Jr. | 123/90.16 |
| 4,469,056 | 9/1984 | Tourtelot, Jr. et al. | 123/90.16 |
| 5,003,939 | 4/1991 | King | 123/90.16 |

FOREIGN PATENT DOCUMENTS

| | | |
|---|---|---|
| 0 717 174 | 6/1996 | European Pat. Off. . |
| 800 616 | 7/1949 | Germany . |
| 42 20 816 A1 | 1/1994 | Germany . |
| 42 26 163 A1 | 2/1994 | Germany . |
| 44 20 064 A1 | 12/1995 | Germany . |
| 2 100 344 | 12/1982 | United Kingdom . |
| WO 95/09298 | 4/1995 | WIPO . |

*Primary Examiner*—Weilun Lo

*Attorney, Agent, or Firm*—Evenson, McKeown, Edwards & Lenahan, P.L.L.C.

[57] ABSTRACT

The invention provides a variable valve gear for internal-combustion engines, in which a control cam of a camshaft acts by way of an interconnected roller onto a swivellable or tiltable valve lever for actuating an upper valve, for achieving a continuous valve timing and stroke adjustment of the upper valve. In the case of a minimal stroke, the roller, by way of an adjustably controlled adjusting lever is positioned in the outer end area of this valve lever and is guided to be swivellable transversely to the cam lift of the control cam.

14 Claims, 3 Drawing Sheets

VARIABLE VALVE GEAR, PARTICULARLY FOR INTERNAL-COMBUSTION ENGINES

BACKGROUND AND SUMMARY OF THE INVENTION

This invention relates to a variable valve gear for an internal combustion engine, of the type which is driven by a camshaft to achieve a continuous timing and stroke adjustment of the valve.

In the known valve gear such as disclosed in German patent document DE-A 42 26 163, to change the valve timing and the course of the valve stroke, the transmission ratio of the valve lever is changed by a controlled displacement of the roller in the longitudinal direction of the valve lever. However, in the case of a normal valve stroke of approximately 8 to 10 mm, by means of the known valve stroke change, no minimal strokes of approximately 2 mm for an intake valve can be achieved, such as is necessary for effective homogenizing of the fuel-air mixture.

It is an object of the present invention to further develop a valve gear of the above mentioned type, in which a normal valve stroke can be continuously reduced to predetermined low stroke values.

This object is achieved by the variable valve gear according to the invention, in which when the roller is positioned close to the valve lever axis (by means of an adjusting lever that is controlled into a first predetermined orientation), it performs no stroke-reducing effective relative movement with respect to the valve lever. On the other hand, when the roller is in a position remote from the valve lever axis (by means of the adjusting lever being controlled into a different orientation), by virtue of its swivel movement it effects a stroke-reducing relative movement with respect to the valve lever and the control cam. The advantage of the invention is that it achieves a continuous adjustment of the valve stroke over a range of, for example, from 10 mm down to approximately 2 mm.

Since the stroke adjustment according to the invention is kinematically accompanied by a change of the cam spread, as an additional important advantage, there is an opening of an intake valve controlled to a minimal stroke, which is possible long before the top dead center of the piston is reached. By using an intake valve that is controlled, for example, in a conventional manner, in a multi-valve combustion space in conjunction with an intake valve controlled according to the invention, the taken-in fuel-air mixture is effectively homogenized, on the one hand, while the gas dynamics are high, on the other hand.

In an embodiment of the invention, a structurally simple adjusting device with low space requirements is achieved by a curved displacement path for the swivel joint, in which the curvature center point of a preferably circular-arc-shaped path is situated on an axis close to the camshaft and in parallel at least to the axis of rotation of the camshaft. By selecting the position of the curvature center point on another axis, the spread and stroke variation can be selected freely with respect to their mutual assignment.

In a further embodiment, an advantageously low space requirement is achieved by providing, between the axis of rotation of the camshaft and an axis of the valve lever, a drive shaft of the adjusting device which is parallel to these axes. This drive shaft is used to drive a control lever which extends partially around the camshaft and has a swivel joint for the adjusting lever which is arranged in the free end area; it displaces the swivel joint in a controlled manner by way of the control lever along a circular-arc-shaped path between an end position above the camshaft and an end position below the camshaft.

By means of the end position of the swivel joint which is above the camshaft, as the result of the swivel direction of the adjusting lever which is thus determined according to the invention, a stroke-reducing relative movement of the roller with respect to the respective valve lever is essentially prevented in a simple manner. By means of the end position of the swivel joint which is below the camshaft, the swivellable adjusting lever causes a stroke-reducing relative movement of the roller with respect to the valve lever and the control cam, by the displacement of the roller in the direction of the free valve lever end.

For kinematic reasons, the roller guide in or on the valve lever is designed to be concentric with respect to the axis of rotation of the camshaft, and to further reduce the stroke, toward the free valve lever end the roller guide changes into a straight line and/or into an arc which is curved in the opposite direction.

A structurally simple and stable further development of a part of the adjusting device is further achieved by arranging the drive shaft of the adjusting device to be disposed between valves of the same type on the engine side, and by non-rotatably connecting it on both sides of this bearing with respective control levers. The control levers have the two swivel joints for the adjusting levers on a common pin.

In a further embodiment, an advantageously secure guiding of the respective roller is achieved by assigning one U-shaped adjusting lever to each of the two control levers, each adjusting lever having the respective roller which is rotatably disposed between the free end areas of its legs adapted to the camshaft in a curved manner.

The invention is preferably used in a valve gear with valve levers designed as rocker levers, in which case the rocker levers are connected by hydraulic valve clearance compensating elements to the respective valve. In this case, the clearance compensating element, which should be maintained in the case of a rocker lever in the conventional arrangement, is also used for the compensation in the roller guides.

The valve gear, which is designed to be variable according to the invention, can advantageously be used in connection with two valves of the same type, which are used as intake valves for adjacent cylinders of an internal-combustion engine. In a further embodiment, this makes it possible to equip each cylinder with an additional intake valve controlled in the conventional manner. While the first intake valve (which, according to the invention is controlled to a minimal stroke) is used to homogenize the mixture and/or to provide an internal exhaust gas return, in contrast, the second intake valve (which opens later and to the full stroke) is suitable to achieve the desired filling of the combustion space. When air alone is fed by way of the second intake valve, the valve gear according to the invention can advantageously be used for lean operation of an internal-combustion engine.

Since the above-described mechanism of the variable valve gear according to the invention is switched in parallel to the main frictional connection by way of the camshaft, the roller, the valve lever and the spring-loaded valve, the forces operating in the control and adjusting lever are relatively low. Thus, a relatively low-power driving motor is sufficient for the adjusting device.

Other objects, advantages and novel features of the present invention will become apparent from the following detailed description of the invention when considered in conjunction with the accompanying drawings.

DETAILED DESCRIPTION OF THE DRAWINGS

Figure 1:
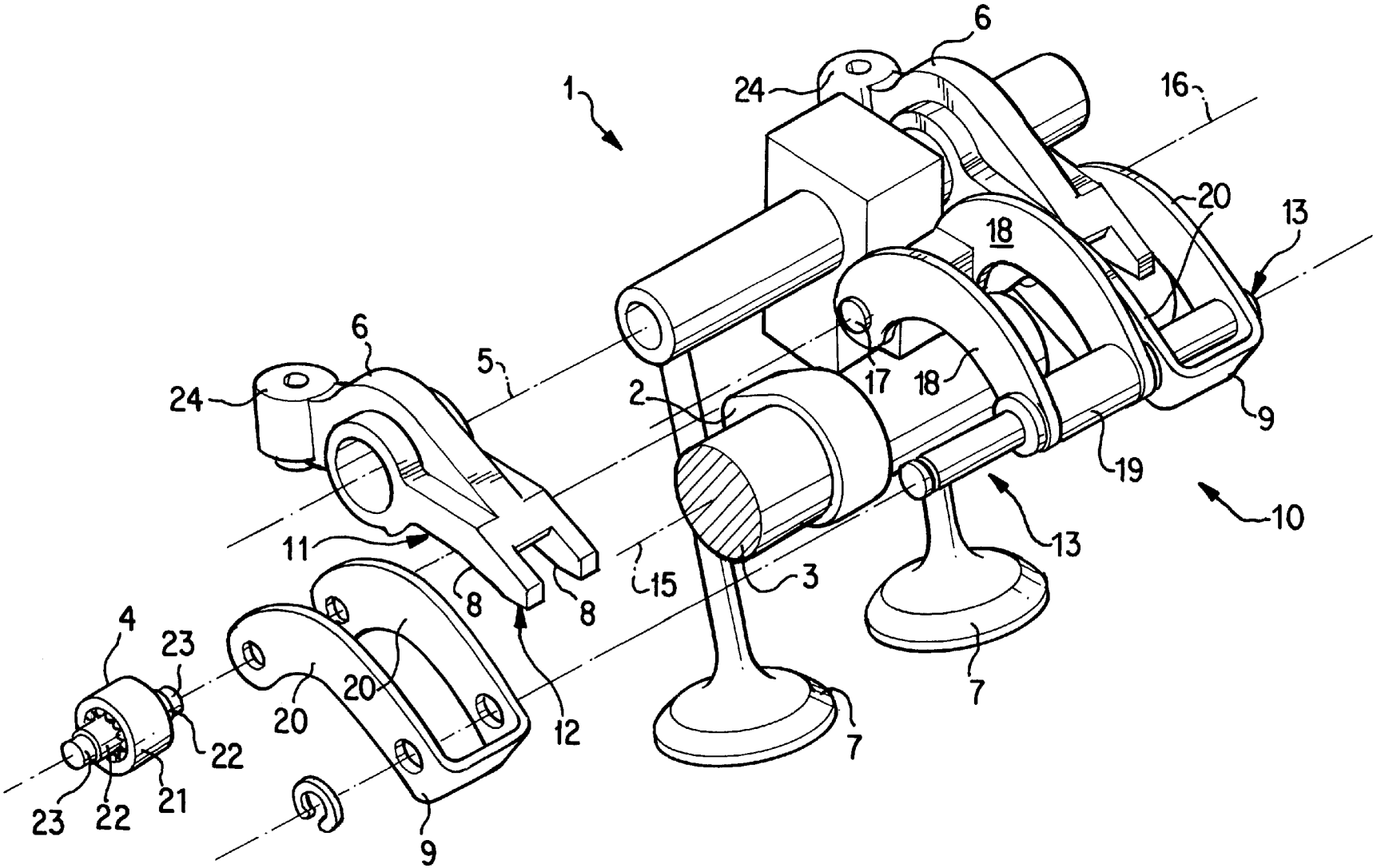
FIG. 1 is a partially exploded depiction of a variable valve gear for two valves.

FIG. 1 shows a variable valve gear 1 for an internal-combustion engine (not shown) according to the invention. A control cam 2 of a camshaft 3 actuates a rocker lever 6 by way of a follower roller 4. The rocker lever 6 is movable about an axis 5, for actuating valve used as an intake valve 7. The roller 4 can be displaced in a controlled manner along a guide 8 on the valve lever or rocker lever 6 by means of a swivellable adjusting lever 9 of an adjusting device 10 arranged on the engine side, between a position range 11 close to the axis 5 of the valve lever and a position range 12 away from the axis 5 of the valve lever.

To achieve a continuous adjustment of the stroke of an intake valve 7 from a conventional stroke range of approximately 8 to 10 mm, to a minimal stroke range of approximately 2 to 1 mm, according to the invention, the swivel joint 13 of the adjusting lever 9, which it has in common with the adjusting device 10, can be displaced in a controlled manner by means of the adjusting device 10 along a path 14 (FIG. 2) in a plane which is essentially perpendicular to the camshaft 3. In this manner, the adjusting lever 9 guides the roller 4 in a position range 11 (FIG. 2) close to the axis 5 of the valve lever between the control cam 2 and the rocker lever 6, moving in a swivelling manner in the direction of the maximal cam lift, and in that the adjusting lever 9 guides the roller 4 in a position range 12 (FIG. 3) remote from the axis 5 of the valve lever, moving along the guide 8 on the rocker lever 6 in a swivelling manner transversely to the cam lift.

To achieve a kinematically simple adjusting device 10, the displacement path 14 of the swivel joint 13 is circular-arc-shaped, and the center of curvature of the path 14 is situated on a parallel line provided between the valve lever axis 5 and the axis of rotation of the camshaft 15—in the frontal view of the valve gear 1. In the top view, a drive shaft 17 of the adjusting device 10 is provided which is aligned with this parallel line 16 between the axis of rotation 15 of the camshaft 3 and the valve lever axis 5. The drive shaft 17 is used to drive control levers 18 which are designed to reach partially around the camshaft 3, and have swivel joints 13 for the adjusting levers 9 arranged at their free ends. The drive shaft 17 can displace the swivel joints 13 in a controlled manner by way of the control levers 18, along a circular-arc path 14 between an end position above the camshaft 3—FIG. 2—and an end position below the camshaft 3—FIG. 3—to achieve a stroke change toward minimal values, as described above.

For kinematic reasons, the roller guide 8 on the rocker lever 6 is designed to be concentric with respect to the axis of rotation 15 of the camshaft 3. For a further reduction of the stroke, the free end of the valve lever can change into a straight line (indicated by reference number 12" in FIG. 3) and/or into an arc which is curved in the opposite manner.

As illustrated in FIG. 1, the drive shaft 17 of the adjusting device 10 is arranged on a bearing disposed between two valves 7 of the same type on the engine side. On both sides of this bearing, the drive shaft 17 is in a non-rotatable connection with control levers 18, in which case the control levers 18 have the two swivel joints 13 for the adjusting levers 9 on a common pin 19. Further, FIG. 1 also shows that U-shaped adjusting levers 9 are assigned to the control levers 18, and that each adjusting lever 9 has a respective roller 4 which is disposed in a rotatable manner between the free end areas 20 of its legs, the latter being designed to reach part way around the camshaft 3 in a curved manner.

Figure 2:
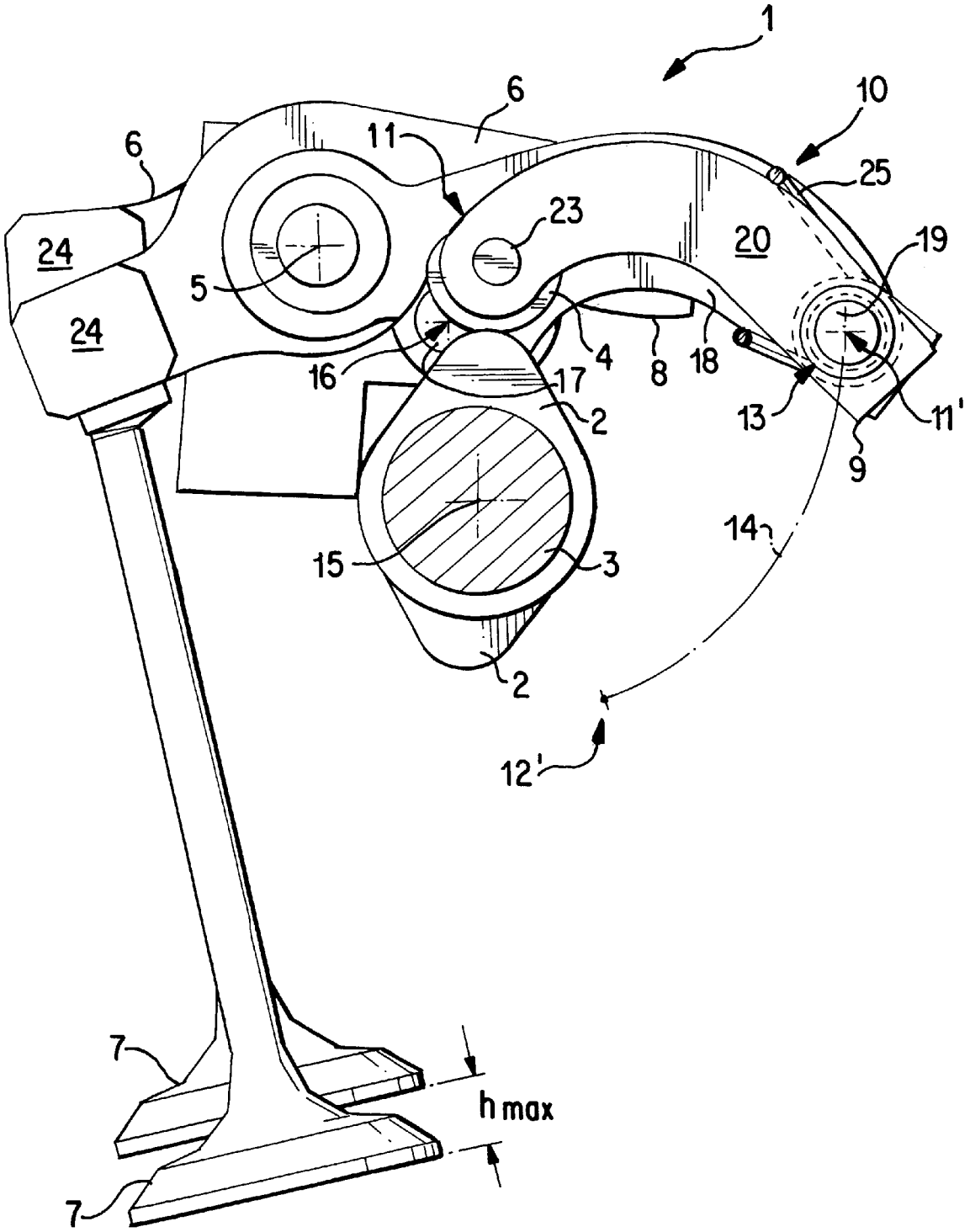
FIG. 2 is a partially sectional view of a roller guided in position range close to the axis of the valve lever by means of the adjusting device according to the invention, between the control cam and the rocker lever for a maximal stroke.
Figure 3:
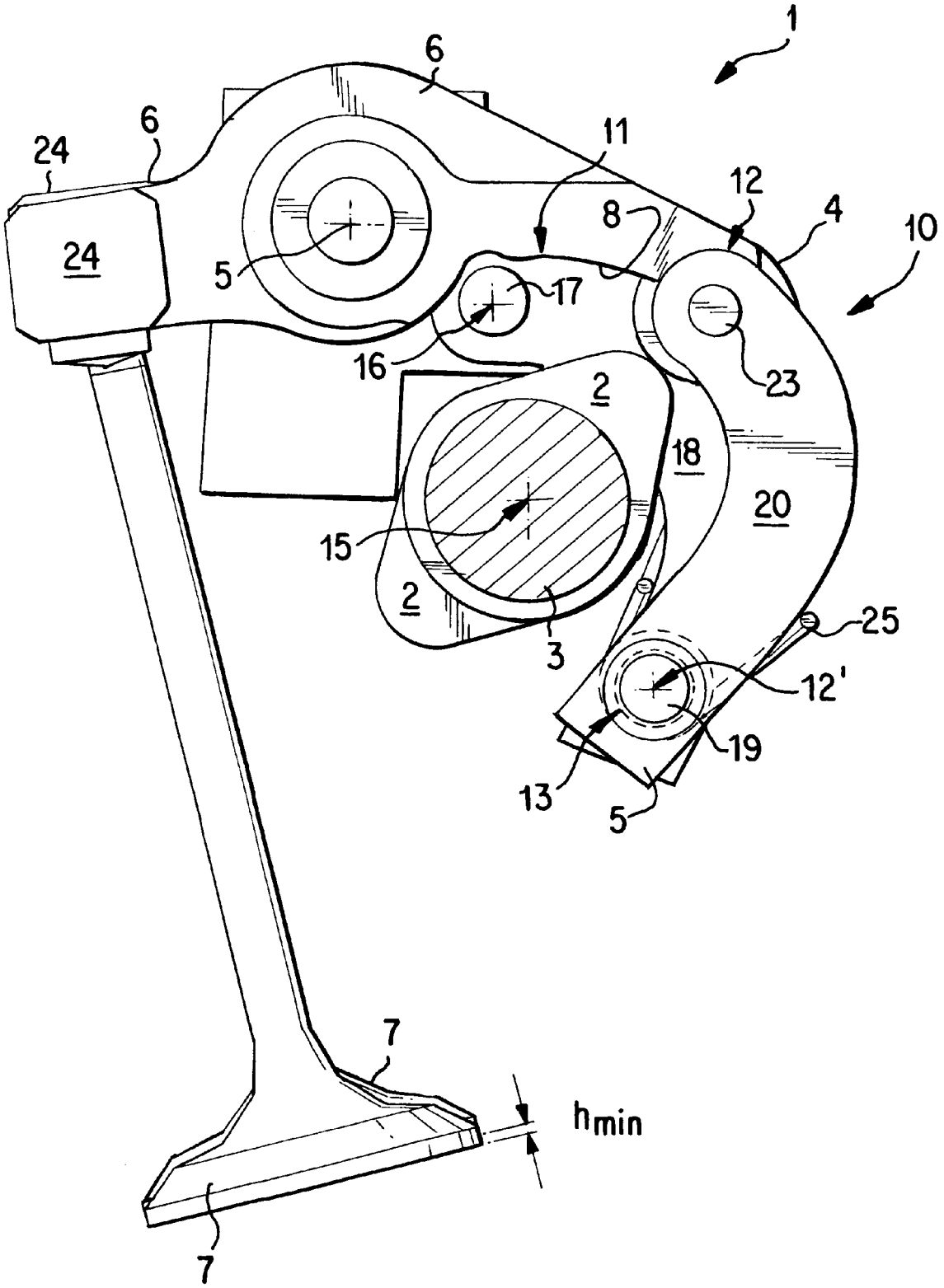
FIG. 3 is a view of the roller held in a position remote from the axis of the valve lever, by means of the adjusting device for a minimal stroke.

As illustrated in FIGS. 1 to 3, the roller 4 interacts by means of its outer ring 21 with the respective control cam 2 of the camshaft 3, while it is connected in a rollable or slidable manner with the guides 8 of the respective rocker levers 6 by way of its pin sections 22. Each roller 4 is arranged by means of set-off end pins 23 in the respective adjusting lever 9 in a secured manner in its leg 20.

The rollers 4 arranged on the adjusting levers 9 interact with rocker levers 6 which are in a driving connection by way of preferably hydraulic valve clearance compensating elements 24 with the respective valve 7.

A restoring spring (not shown) for each valve 7 causes the roller 4 to remain in contact with the control cam 2, by way of the respective rocker lever 6. For a secure contact of the roller 4 on the control cam 2, particularly in the position range 12 away from the axis of the valve lever, a spring element is provided which promotes this contact and is correspondingly applied to the adjusting lever 9. This spring element, which is preferably provided as a leg spring 25 between the adjusting lever 9 and the control lever 18, may be designed with respect to an amount-related proportion of the above-mentioned restoring spring whose design is or can be reduced by this amount.

The valve gear 1, which is designed to be variable according to the invention, can advantageously be used in the case of two valves 7 of the same type which are used as intake valves, for two adjacent cylinders of an internal-combustion engine which are not shown. In a further embodiment, it is possible to assign to each cylinder equipped with an intake valve 7 whose stroke can be varied according to the invention, an additional intake valve which is controlled in a conventional manner.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A variable valve gear for an internal combustion engine, comprising:

a cam shaft;

a control cam mounted on the cam shaft;

a valve lever which is movable about a first axis for actuating a valve;

a roller which couples said control cam to actuate said valve level; and an adjusting device for displacing said roller between a first position which is close to the first axis and a second position which is remote from the first axis, said adjusting device being movably arranged about a second axis which is fixed to said engine, and comprising a guide surface provided on said valve lever for guiding said roller between said first and second positions, said guide surface having an arc shape which is concentric to a rotating axis of said camshaft;

a swivellable adjusting lever which supports said roller;

a control lever which can reach at least partially around the camshaft, and is swivellable about the second axis;

a swivel joint swivellably coupling a free end of the control lever to the swivellable adjusting lever which supports the roller, said swivel joint being displaceable about said second axis along an arc shaped displacement path, whereby the roller is guided by said adjusting lever between the control cam and the guide surface of the valve lever, between said first position which provides a maximal camming movement of the valve lever by the control cam, and said second position, which is in the area of a free end of the valve lever and provides a minimal camming movement of said valve lever, said free end of the valve lever having a surface contour which is one of a straight line and arcuate.

2. Variable valve gear for an internal combustion engine, comprising:

a valve lever which is movable about a first axis, for actuating a valve;

a control cam of a camshaft;

an interconnected roller that couples said control cam to actuate said valve lever;

an adjusting device having a swivellable adjusting lever which supports the roller; and a guide associated with the valve lever, the roller being displaceable in a controlled manner along the guide, by means of the swivellable adjusting lever, between a first position which is close to the first axis and a second position which is remote from the first axis, said guide having a surface at least part of which is concentric to a rotating axis of the camshaft, and said adjusting device being movably arranged about a second axis which is fixed to said engine; wherein said adjusting device includes a control lever which can reach partially around the camshaft, is swivellable about the second axis, and has arranged at its free end area a swivel joint for the swivellable adjusting lever, which supports the roller;

by way of an arc shaped displacement path of the swivel joint, the roller is guided via the swivellable adjusting lever between the control cam and the guide of the valve lever;

by means of said arc shaped displacement in a first direction the roller can be moved into the first position, disposed along the guide, in which first position actuation of said valve lever by said control cam causes a maximal cam movement of the valve lever; and by means of said arc shaped displacement in a second direction the roller can be moved into the second position, disposed along the guide in the area of a free end of the valve lever, in which second position actuation of said valve lever by said control cam causes a minimal cam movement of the valve lever, said free end of the valve lever having a surface contour which is one of a straight line and arcuate.

3. Valve gear according to claim 2, wherein:

the displacement path has a circular arc shape, with a center of curvature which is situated on one of the valve lever axis, an axis of rotation of the camshaft, and/or a parallel line with respect to these axes.

4. Valve gear according to claim 2, wherein:

a drive shaft of the adjusting device is provided between an axis of rotation of the camshaft and the valve lever axis, and has an axis which is in parallel thereto, and which displaces the swivel joint in a controlled manner by way of the control lever along the circular-arc path between an end position above the camshaft and an end position below the camshaft.

5. Valve gear according to claim 2, wherein:

a drive shaft of the adjusting device is supported on a bearing between two valves of the same type on the engine side, and on both sides of said bearing is in a non-rotatable connection with one control lever respectively, the control levers having the two swivel joints for the adjusting levers on a common pin.

6. Valve gear according to claim 5, wherein:

one U-shaped adjusting lever respectively is assigned to the control levers, each adjusting lever having the respective roller rotatably disposed between free end areas of its curved legs.

7. Valve gear according to claim 6, wherein the rollers arranged on the adjusting levers interact with valve levers designed as rocker levers, the rocker levers being in a driving connection with the respective valve by way of hydraulic valve clearance compensating elements.

8. Valve gear according to claim 7, wherein that two valves of the same type are used as intake valves for two adjacent cylinders of an internal-combustion engine.

9. Valve gear according to claim 2, wherein a normally controlled intake valve and an intake valve which is additionally controllable by means of the adjusting device are provided for each cylinder of an internal-combustion engine.

10. Valve gear according to claim 8, wherein on the adjusting lever, at least in the second position of the roller, a spring element secures the contact of the roller on the control cam.

11. Valve gear according to claim 10, wherein the spring element is a leg spring which drives the adjusting lever in the direction of the control lever.

12. Valve gear according to claim 11, wherein the leg spring is designed corresponding to an amount-related proportion of a restoring spring of the valve, and the restoring spring is designed to be reduced by this amount.

13. A variable valve gear for an internal combustion engine, comprising:

a cam shaft;

a control cam mounted on the cam shaft;

a valve lever which is rotatable about a first fixed axis;

a roller which couples the control cam to actuate the valve lever;

a swivellable adjusting lever which supports the roller;

a control lever which is swivellable about a second fixed axis, which is spacially separated from said first fixed axis; and a swivel joint which couples the control lever at a point which is movable about the second fixed axis, to an end of the adjusting lever opposite the roller; and a guide surface provided on the valve lever for guiding a movement of the roller between first and second positions; wherein the swivel joint is displaceable about the second axis along an arc shaped displacement path, whereby the roller is guided by the adjusting lever between the control cam and the guide surface of the valve lever, between said first position which provides a maximal camming rotation of the valve lever by the control cam, and said second position which provides a minimal camming rotation of the valve lever; and the first position of the roller is relatively closer to the first fixed axis than it is in the second position of the roller.

14. A variable valve gear for an internal combustion engine according to claim 13 wherein in the first position of the roller, the swivel joint is relatively more remote from an axis of rotation of the control cam than it is in the second position of the roller.

* * * * *